United States Patent [19]

Gray, Jr.

[11] Patent Number: 5,035,070

[45] Date of Patent: Jul. 30, 1991

[54] BOOT LOGO HOLDER

[76] Inventor: Cecil D. Gray, Jr., Rte. 3, Box 25, Snyder, Tex. 79549

[21] Appl. No.: 489,495

[22] Filed: Mar. 7, 1990

[51] Int. Cl.[5] ..... A43B 23/00

[52] U.S. Cl. ..... 36/136; 36/1; 36/70 R; 36/72 R

[58] Field of Search ..... 36/1, 70 R, 72 R, 138, 36/132, 136; 40/636

[56] References Cited

U.S. PATENT DOCUMENTS

| | | | |
|---|---|---|---|
| 281,213 | 7/1883 | Watkinson | 36/70 R |
| 586,666 | 7/1897 | Neuendorf | 36/70 R |
| 806,579 | 12/1905 | Schakel | 36/70 R |
| 898,503 | 9/1908 | Plummer | 36/70 R |
| 927,017 | 7/1990 | Young | 36/70 R |
| 1,005,401 | 10/1911 | Young | 36/70 R |
| 1,502,919 | 7/1924 | Seib | 36/136 R |
| 2,489,368 | 11/1949 | Faybert | 36/70 R |
| 3,114,982 | 12/1963 | McGowan | 36/136 |
| 3,844,054 | 10/1974 | Morris | 36/1 |
| 4,597,197 | 4/1986 | Strasinger | 36/136 X |
| 4,621,441 | 11/1986 | Wagnet et al. | 36/136 X |
| 4,693,022 | 9/1987 | Terhune | 36/132 |
| 4,698,921 | 10/1987 | Townsend | 36/136 X |
| 4,712,319 | 12/1978 | Goria | 36/136 X |
| 4,852,276 | 8/1989 | Savoca et al. | 36/136 |
| 5,884,432 | 8/1897 | Holmes | 36/70 R |

FOREIGN PATENT DOCUMENTS

| | | | |
|---|---|---|---|
| 683 | 9/1877 | Fed. Rep. of Germany | 36/70 R |
| 58247 | 11/1890 | Fed. Rep. of Germany | 36/70 R |
| 337665 | 2/1903 | France | 36/70 R |
| 412299 | 2/1910 | France | 36/70 R |
| 618948 | 3/1927 | France | 36/70 R |
| 1442 | 12/1885 | Italy | 36/70 R |
| 469 | 2/1878 | United Kingdom | 36/70 R |
| 9811 | 4/1893 | United Kingdom | 36/70 R |
| 911 | 1/1894 | United Kingdom | 36/70 R |
| 1144655 | 3/1969 | United Kingdom | 36/126 |

*Primary Examiner*—Paul T. Sewell
*Assistant Examiner*—BethAnne C. Cicconi
*Attorney, Agent, or Firm*—Wendell Coffee

[57] ABSTRACT

An attachment that connects a decorative logo to footwear. The logo is displayed along the lower leg outside the pant leg. The logo can be attached to either a shoe or a boot. The attachment takes the form of a U-shaped holder when being attached to a boot and the form of a L-shaped holder when being attached to a shoe. The attachment includes a vertical strip of plastic which projects upward from the footwear towards the knee on the outside of the pant leg. It is on top of this vertical strip that the decorative logo is placed. The logo can be displayed at various heights by varying the length of the vertical strip and the attachment is painted so that it blends into the background of the pant leg. Another benefit provided by the attachment is that it restrains the pant leg at a height above ground level preventing the soiling of the pant leg.

11 Claims, 2 Drawing Sheets

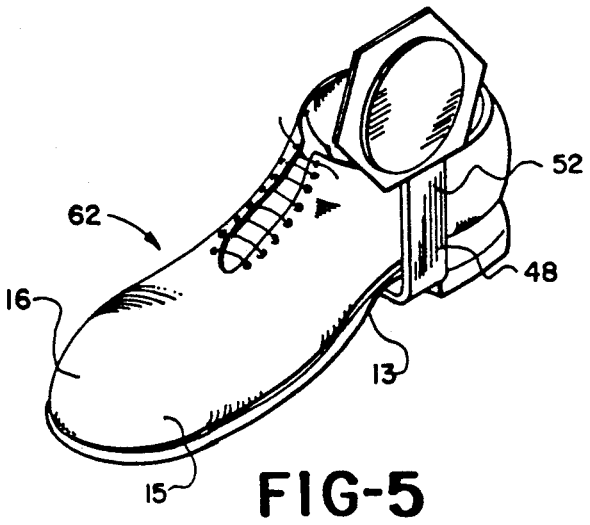
FIG-5
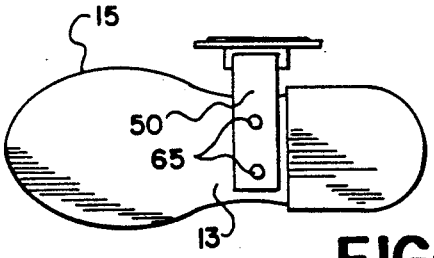
FIG-6
FIG-7
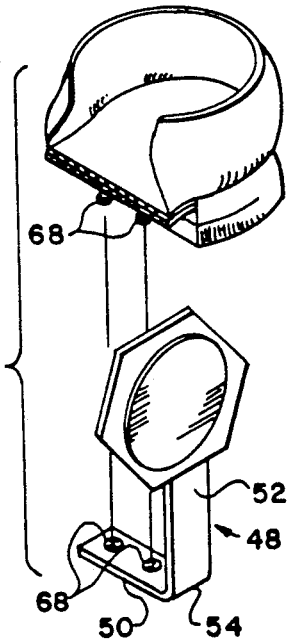
FIG-8
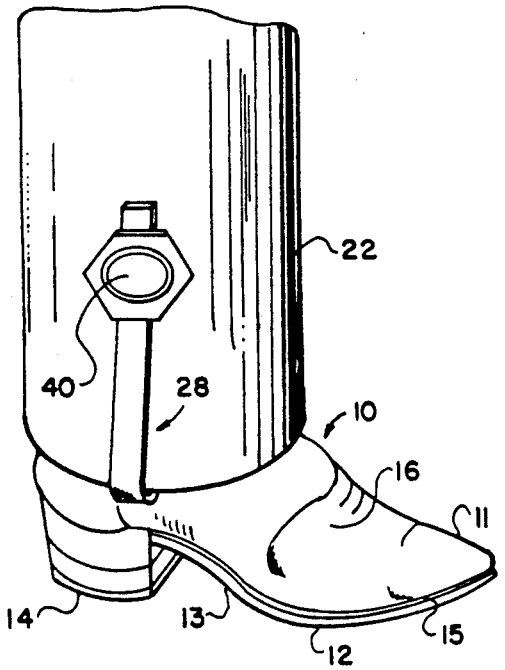

BOOT LOGO HOLDER

RIGHTS TO INVENTIONS UNDER FEDERAL RESEARCH

There was no federally sponsored research and development concerning this invention.

BACKGROUND OF THE INVENTION (1) Field of the Invention

This invention relates to holders which attach to footwear and display logos outside the pant leg. Those with ordinary skill in the art are designers and makers of footwear.

(2) Description of the Related Art

Boots and shoes are well known forms of protective foot gear. The parts of shoes and boots are generally constructed from a sturdy material such as leather; the foot covering having one layer of material while the sole may have several laminated layers or one layer which is thicker than that used for the foot covering. In the case of a boot, a tubular leg covering for the lower leg is attached to the foot covering. The purpose of the leg covering is to provide a similar protective barrier between the lower leg and environmental hazards much like the foot covering provides the foot.

Boots are often worn by construction workers and other laborers who are concerned with protecting their feet and lower legs while performing their duties. Today the styling of the boot has evolved to include versions which have more emphasis on fashion than utility. As a result, there are many different styles of boots.

The evolution and use of the cowboy boot was necessitated by the hazards to the feet and lower leg presented by the environment in which the cowboy worked. Even though these men were usually on horseback when wrangling cattle, there were still bushes and briars high enough to scrape a rider's legs. When not on horseback, the cowboy walked through range lands which were fraught with other prickly hazards such as rattle snakes and cactus. For this reason the additional leg protection provided by the tubular leg covering of the boot was desirable.

Today, the cowboy boot is worn less for practical purposes and more as an avenue for stylistic expression. The environment in which most cowboy boots are now worn presents little threat to the lower leg, however, the tubular leg protection has been retained as part of the cowboy boot's design.

Today's wearer of cowboy boots makes a fashion statement by way of his choice in foot apparel; that statement is that he associates himself with the country and western lifestyle.

There is a distinctive style of dress associated with the country and western lifestyle and includes several specific characteristics. A predominate characteristic of the country and western style of dress is the use of accessories to coordinate the various pieces of clothing being worn and may even be extended to coordinate with horseback riding gear. The riding gear is often adorned with silver decorations called "conchos" which are attached to the saddle and other parts of the riding gear. The conchos are often embossed with the rider's initials, the symbol of his ranch, or other designs of significance.

Accessories with similar emblems are often worn on several pieces of clothing in an effort to coordinate more completely entire outfits. When accessorizing, more emphasis is placed on the upper body because these areas are more easily and frequently seen by others. For this reason the lower portions of the body and the apparel that covers those areas is frequently left unaccessorized. This is especially true for the lower extremities.

Most structures that are designed to be attached to either shoes or boots have purposes other than decoration or fashion coordination. For examples of these types of attachments, see the following United States Patents:

Puffer U.S. Pat. No. 668,051 Trousers Protector

Plummer U.S. Pat. No. 898,503 Overshoe Holder and Trousers Supports

Young U.S. Pat. No. 1,005,401 Trousers Protector

Knodle U.S. Pat. No. 2,557,663 Shoe Advertising Attachment

Morris U.S. Pat. No. 3,844,054 Stabilizer for a Shoe

The above referenced related art is predominantly utilitarian in nature and not decorative. The Puffer, Young, and Plummer patents all have the primary purpose of supporting the bottom of the trouser leg at some elevation above ground level. All three of these patents show an apparatus that is attached to the back of the foot covering at the heel. The purpose of these inventions is to restrain the pant leg at a height high enough so that the pant leg does not drag the ground or extend below a specific point on the shoe. The Morris patent shows a stabilizer that is attached to the sole of the shoe. It is neither decorative in nature nor does it interact with the pant leg. The Knodle patent could be construed as decorative in nature, but the design is displayed on the foot covering of a shoe just below the ankle. Like the Morris patent, this attachment does not interact with the pant leg.

E. SUMMARY OF THE INVENTION (1) Progressive Contribution to the Art

This invention is an attachment which makes it possible to connect a decorative logo to footwear and display the logo outside the pant leg along the lower leg. The logo can be displayed from either a shoe or a boot by way of a holder on which the logo is placed.

A country and western outfit is often coordinated through the attachment of similar logos to different pieces of apparel. This invention makes it possible for a similarly coordinated logo to be displayed along the lower leg.

The best mode contemplated by the inventor is a U-shaped holder that attaches to the tubular leg covering of a boot. The holder is constructed out of a clear plastic that is then painted. The U-shaped holder is formed by bending a straight flat strip of plastic along it midsection until the strip is deformed into a U-shape by way of a 180 degree bend. The bend is a smooth curve and serves as the bottom of the U-shaped holder. After being bent, the linear axes of the two straight portions of the holder are parallel. This U-shape can also be accomplished by molding the plastic into this shape.

The two straight lengths of the U-shape holder take the form of two flat strips; one of which attaches to the tubular leg covering of the boot. When attached to the boot, the holder is oriented so that the linear axes of the flat strips are parallel to the center axis of the leg covering and the bend of the holder is nearest the heel. The holder is positioned on the surface of the leg covering so that it is above the side of the foot covering that covers the little toe side of the foot. This is the side of the footwear that is away from the other foot. For clarity, the two sides of the footwear will be referred to as the "little toe side" and the "big toe side".

When attached to the boot, the U-shaped holder creates a bight into which the pant leg is placed. When the holder is properly fixed to the boot and the pant leg is placed in the holder, the attached or inside flat strip of the holder is inside the pant leg.

The inside flat strip of the U-shaped holder can be attached to the leg covering of the boot by several means. It is desirable that it be possible for the holder to be quickly and easily attached to and detached from the boot. This ease in application and removal of the holder is necessary because the same boot may be worn at times when the display of a logo is appropriate and at other times when it would be cumbersome for the holder to be in place. If the boot is worn at work, the U-shaped holder may prove to be a hinderance. On the other hand, there are specific times when the display of a decorative logo is desirable. This would be when coordination of the outfit outweighs practicality.

The inside flat strip of the U-shaped holder is attached to the tubular leg covering of the boot in two places by way of two snap coupling devices. These snaps are specially constructed so that they easily detach when tension is applied to a specific area on the edge of the snap while at the same time the snaps resist detachment when tension is applied to any other part of the snap's circumference. The snap is then oriented so that the limited area which is susceptible to separation is toward the top of the leg covering. In this way the holder is held fast to the boot once it is installed and until tension is applied at the top end of the inside flat strip of the U-shaped holder. Another possible but less attractive embodiment is that the U-shaped holder could be permanently riveted to the leg covering of the boot at the same points that it is snapped.

The logo can be positioned at any elevation above the bottom bend of the holder and below the knee by varying the length of the outside flat strip. Additionally, when the logo is installed onto the U-shaped holder and in position for display, attention is to be drawn only to the logo while the holder remains inconspicuous. By painting the holder a color similar to the pant leg, the holder is less visible against the background that the pant leg creates. Because of the many combinations made possible by having holders of varying outside flat strip lengths and different colors, several different holders will likely be used by an individual with each holder being tailored with respect to color and height of display.

While it is desirable to have the ability to position the decorative logo at various heights along the lower leg, it is equally desirable to be able to interchange the logos themselves. In the best mode contemplated by the inventor, the logo is attached to the top of the outside flat strip of the U-shaped holder by way of a logo fitting which is fixed to the back of the logo and has dimensions, with respect to width and thickness, equal to those dimensions of the outside top end of the flat strip of the holder. The dimensions of the logo fitting and the outside flat strip, with respect to width and thickness, are sufficiently similar to cause a snug fit when the fitting is slipped down over the top end of the outside flat strip. The weight of the logo as well as friction between the fitting and the outside flat strip keep the logo seated firmly in place upon the outside flat strip. The logo can also be permanently riveted to the outside flat strip of the holder if only one logo is to be displayed.

An additional benefit provided by the U-shaped holder is that it restrains the pant leg. When placed in the bight of the holder, the pant leg is prevented from dragging the ground in the event that it is long enough to do so.

It is envisioned that there could be several variations on the above described embodiment of the U-shaped holder. For instance, the means for attaching the inside flat strip of the holder to the tubular leg covering could be Velcro. The Velcro would provide a mode similar to the snaps for fixing the holder to the boot in that it would allow quick installation and removal of the holder.

An alternative method for attaching the U-shaped holder to the leg covering uses a sleeve which is typically fabricated from leather and is sewn to the leg covering. To create this sleeve, a piece of leather which has a slightly greater width than the inside flat strip of the U-shaped holder is sewn about its perimeter to the little toe side of the leg covering. This sleeve is oriented along the outer surface of the leg covering so that its linear center line is parallel to the center axis of the leg covering. The bottom edge of the sleeve is not sewn to the boot. Instead it is left open so that the inside flat strip of the U-shaped holder can be slipped up into the sleeve. The holder is held in place by the friction created between the sleeve and the inside flat strip which has been inserted. The friction between these elements is sufficient to hold the holder in place while the logo is being displayed. The primary benefit afforded by the use of the sleeve is that the strip of material used for creating the sleeve is chosen so that it matches the material used in the fabrication of the tubular leg covering. When the holder is not connected to the boot, the attaching sleeve is inconspicuous against the background of the leg covering. A variation on the sleeve is to leave the top, as well as the bottom of the sleeve open so that the top end of the inside flat strip projects out of the sleeve when fully inserted. This would allow for tying or otherwise fixing the holder into position on the leg covering.

Another embodiment includes a holder which is L-shaped. Like the U-shaped holder, this L-shaped holder is created by bending a straight strip of plastic into a 90 degree right angle. The two legs of this 90 degree angle are of different lengths. The shorter leg is attached to the footwear. It is attached by riveting the holder to the instep of a shoe. The longer leg of the holder extends vertically up the lower leg on the little toe side of the shoe and serves a purpose similar to that of the outside flat strip of the U-shaped holder. It is on the top of this vertical flat strip that the logo is placed.

(2) Objects of this Invention

A further object of this invention is to provide a mode for coordinating a country and western style outfit.

An object of this invention is to provide a structure which makes it possible to display a decorative logo outside the pant leg along the lower leg by fixing the logo to a holder which is attached to either a shoe or a boot.

A further object of this invention is to restrain the pant leg at an elevation which is sufficiently above ground level to prevent the soiling of that pant leg.

Further objects are to achieve the above with devices that are sturdy, compact, durable, lightweight, simple, safe, efficient, versatile, ecologically compatible, and reliable, yet inexpensive and easy to manufacture, install, and maintain.

Other objects are to achieve the above with a method that is rapid, versatile, ecologically compatible, efficient, and inexpensive, and does not require highly skilled people to install, and maintain.

The specific nature of the invention, as well as other objects, uses, and advantages thereof, will clearly appear from the following description and from the accompanying drawings, the different views of which are not necessarily scale drawings.

F. BRIEF DESCRIPTION OF THE DRAWINGS

FIG. 5 is a perspective view of a logo and holder installed onto a shoe.

FIG. 6 is a bottom plan view of a first embodiment of the invention shown in FIG. 5.

FIG. 7 is an exploded perspective view of a second embodiment of the invention as shown in FIG. 5.

FIG. 8 is a perspective view of the invention with a pant leg being restrained by the holder.

Figure 1:
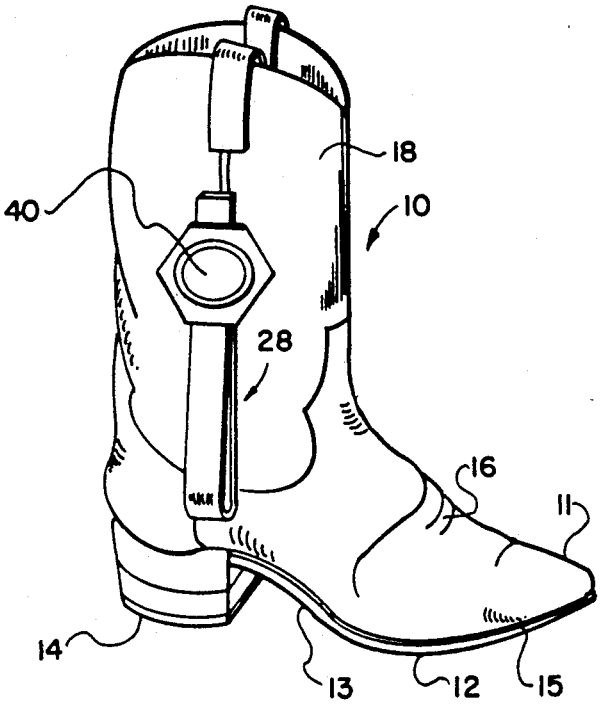
FIG. 1 is a perspective view of a holder installed onto the leg covering of the boot according to this invention.
Figure 2:
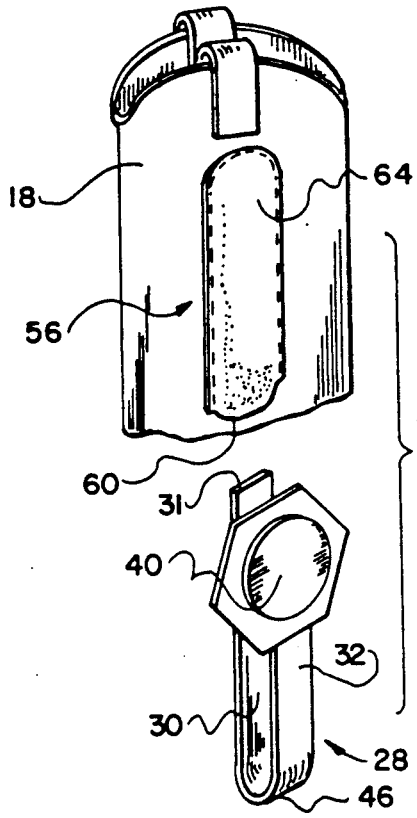
FIG. 2 is an exploded perspective view of a first embodiment thereof.
Figure 4:
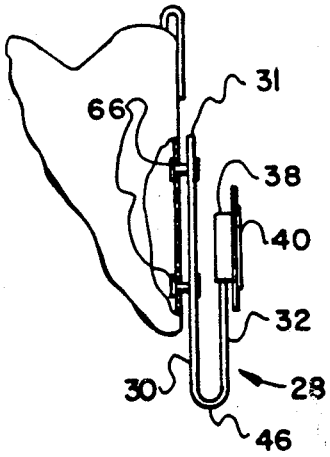
FIG. 4 is a front elevational view, showing a partial cut away of a third embodiment thereof.
Figure 3:
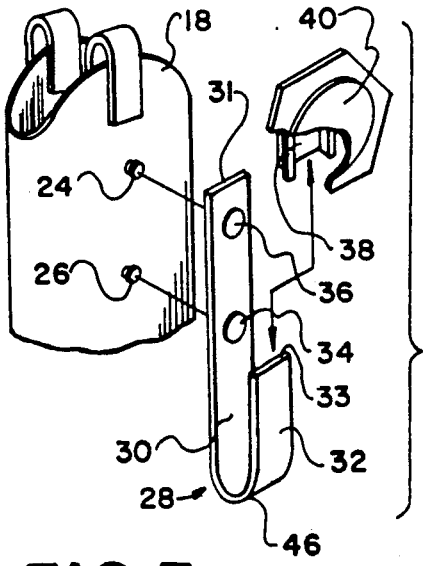
FIG. 3 is an exploded perspective view of a second embodiment thereof.

As an aid to correlating the terms of the claims to the exemplary drawing(s), the following catalog of elements and steps is provided:

10 Boot
11 Big toe side
12 Sole
13 Instep
14 Heel
15 Little toe side
16 Foot covering
18 Tubular leg covering
22 Pant leg
24 Upper male snap half
26 Lower male snap half
28 U-shaped holder
30 Inside flat strip
31 Inside top end
32 Outside flat strip
33 Outside top end
34 Lower female snap half
36 Upper female snap half
38 Logo fitting
40 Logo
46 180 Degree bend
48 L-shaped holder
50 Horizontal flat strip
52 Vertical flat strip
54 90 degree bend
56 Sleeve
60 Bottom opening
62 Shoe
64 Strip
65 Rivet
66 Boot Rivets
68 Shoe snaps

DESCRIPTION OF THE PREFERRED EMBODIMENTS

Referring to the drawings, there may be seen a boot 10 with big toe side 11 and little toe side 15 which is made up of several parts. Sole 12 serves as the bottom of the front portion of the boot 10 which is under the toes and ball of the foot. Instep 13 is under the middle of the foot at the back of the sole 12. Heel 14 is at the back of the boot 10 and is under the heel of the foot. Together, the sole 12, the instep 13, and the heel 14 create the covering for the bottom of the foot and are permanently fixed to foot covering 16. The foot covering 16 extends from the outer edges of the sole 12, the instep 13, and the heel 14 up and over the top of the foot creating a protective sheath for the foot. Tubular leg covering 18 is joined to the foot covering 16 above the heel 14. The tubular leg covering 18 extends up the leg from the foot covering 16 to a point below the knee forming a protective tube about the lower leg.

In the first embodiment, upper snap and lower snap are snap coupling devices each of which includes a male and a female mating parts. Upper male snap half 24 and lower male snap half 26 are located on the outer surface of the leg covering 18 on little toe side 15 of the boot 10. The two male halves are arranged so that the lower male snap half 26 is below the upper male snap half 24 and is on a line which passes through both snap halves and is parallel to the center axis of the leg covering. The male snap halves are oriented so as to mate with the female snap halves at the outside surface of leg covering 18.

U-shaped holder 28 is formed by bending a flat strip of plastic along its midsection until the strip is deformed into a U-shape creating 180 degree bight or bend 46. The bend 46 is a smooth curve and serves as the bottom of the U-shaped holder 28. After being bent, the two straight portions of the holder 28 are parallel to each other. These straight portions of the holder 28 are referred to as inside flat strip 30 and outside flat strip 32. When the holder 28 is installed on boot 10, the inside flat strip 30 fits up against the leg covering 18 with the outside flat strip 32 extending away from the leg covering 18. Inside top end 31 and outside top end 33 of the inside flat strip 30 and the outside flat strip 32 respectively, are at the opposite end of the holder 28 from the bend 46. The female halves of the snaps and are fixed in the inside flat strip 30 so that upper female snap half 36 and lower female snap half 34 are oriented so as to mate with male snap halves 24 and 26 at the outside surface of the inside flat strip 30.

When the snaps and are in the coupled configuration with the male halves 24 and 26 mated to the female halves 36 and 34 respectfully, the snaps and attach the U-shaped holder 28 to the tubular leg covering 18. When the holder 28 is attached to the boot 10, the outside flat strip 32 extends away from the leg covering 18 a distance which is governed by the curvature of the 180 degree bend 46. Logo 40 may be displayed at various heights along the lower leg by varying the length of the outside flat strip 32.

The U-shaped holder 28 may also be permanently attached to the leg covering 18 by boot rivets 66.

Logo fitting 38 is attached to the back of the decorative logo 40 and provides the means for attaching the logo 40 to the outside top end 33. The fitting 38 is constructed as an open ended box which has a thickness and width equal to the thickness and width of the outside top end 33. When the logo fitting 38 is installed onto the outside top end 33, the fit is sufficiently snug so that there is resistance to the logo 40 being lifted off and separated from the holder 28. However, the resistance created by the friction between the logo fitting 38 and the outside top end 33 is easily over come by hand and allows for the quick and easy exchange of different decorative logos 40.

With pant leg 22 extended down into the bight created by the U-shaped holder 28, the inside flat strip 30 is not visible outside the pant leg 22. The outside flat strip 32, however, is visible because it extends outside and beyond the properly positioned pant leg 22. When properly positioned, the bottom of the pant leg 22 rests in the bend 46.

Another embodiment of this same invention is L-shaped holder 48. Like the U-shaped holder 28, the L-shaped holder 48 is fashioned from a flat straight strip of plastic. This strip of plastic is bent along its midsection creating 90 degree bend 54. The L-shaped holder 48 is then attached to the instep 13 of shoe 62. The shoe 62 includes all of the same component parts as the boot 10 excepting the tubular leg covering 18; that is the sole 12, the instep 13, the heel 14, and the foot covering 16. The holder 48 is attached to the shoe 62 permanently by riveting the holder 48 to the instep 13 of the shoe 62 with rivet 65.

When attached to the instep 13, the L-shaped holder 48 is oriented so that the top surface of the horizontal flat strip 50 contacts the instep 13 of the shoe 62 and vertical flat strip 52 projects upwardly on the little toe side 15 of the shoe 62 towards the knee.

The vertical flat strip 52 serves similarly to the outside flat strip 32 of the U-shaped holder 28. The logo fitting 38 is placed over the vertical top end of the holder just as it was placed in position on the outside top end 33 of the U-shaped holder 28.

The L-shaped holder 48 may also be attached to the instep 13 of the shoe 62 by shoe snaps 68. The female halves of the shoe snaps 68 are located on the top surface of the vertical flat strip 52. The male halves of the shoe snaps 68 are located on the instep 13 of the shoe 62. These snap halves are oriented so that when mated, the holder 48 is positioned so that the vertical flat strip 52 projects upwardly on the little toe side 15 of the shoe 62 towards the knee.

Still another embodiment of this same invention retains the use of the U-shaped holder 28 but employs a different method for attaching the holder 28 to the tubular leg covering 18. Over the area of the leg covering 18 that the inside flat strip 30 of the U-shaped holder 28 is adjacent to when the holder 28 is in the previously described attached configuration, strip 64 which has a width just greater than the width of the inside flat strip 30 is sewn. The seam by which the strip 64 is attached to the leg covering 18 completely encircles the strip 64 about its perimeter at all points except for bottom opening 60 between the strip 64 and the leg covering 18. When the strip 64 is sewn to the leg covering 18, it creates sleeve 56. Through the bottom opening 60 at the bottom of the sleeve 56, the inside flat strip 30 of the holder 28 is slipped into the sleeve 56. The sleeve 56 fits snugly about the flat strip 30 creating friction sufficient to hold the U-shaped holder 28 in the position it is placed on the leg covering 18. A variation of this embodiment leaves the top of sleeve 56 open so that when the inside flat strip 30 is slid up into the sleeve 56, the inside top end 31 projects beyond the top end of the sleeve 56.

The embodiments shown and described above are only exemplary. I do not claim to have invented all the parts, elements or steps described. Various modifications can be made in the construction, material, and arrangement, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A decorative logo attachment upon a. a shoe having
   i. a big toe side and little toe side,
   ii. a sole,
   iii. an instep,
   iv. a heel, and
   v. a foot covering, wherein the improvement comprises the following structure in combination with the above:

b. a L-shaped holder having a horizontal flat strip and a vertical flat strip connected by a 90 degree bend with the vertical strip having a width and thickness;
c. fastener means for attaching said holder to said shoe;
d. a decorative logo having a back; and
e. fastener means for attaching said logo to said holder having:
   i. a logo fitting in the form of a box shaped structure with dimensions equal to those of the vertical flat strip with respect to width and thickness;
      1. said fitting is closed on all sides except for a bottom which is open and has dimensions equal to those of the vertical flat strip; and
      2. said fitting is permanently fixed to the back of the decorative logo.

2. A decorative logo attachment upon a. a boot having;
   i. a big toe side and little toe side,
   ii. a sole,
   iii. an instep,
   iv. a heel,
   v. a foot covering, and
   vi. a tubular leg covering with a top;

wherein the improvement comprises the following structure in combination with the above:

b. a U-shaped holder having:
   i. an inside flat strip connected to an outside flat strip by a 180 degree bend,
   ii. said 180 degree bend at the bottom of both strips,
   iii. said 180 degree bend closer to the instep than to the top of the leg covering,
   iv. an outside top end on the outside strip, and
   v. said U-shaped holder opens upward toward the top of the leg covering so that a pant leg may be inserted into said U shaped holder;
c. fastener means on the tubular leg covering on the little toe side of the boot for interconnecting the holder to the leg covering on the little toe side of the boot; and
d. a decorative logo attached to the outside top end of the outside flat strip so that said logo is displayed outside the pant leg above the foot covering and heel of the boot.

3. The invention as defined in claim 2 wherein the U-shaped holder is attached to the boot by:

e. upper and lower snaps having:

i. an upper male snap half and lower male snap half, both fixed to the outer surface of the leg covering on the little toe side of the boot;

ii. said male snap halves being arranged so that the lower male snap half is below the upper male snap half and is on a line which passes through both snap halves and which line is parallel to a center axis of the leg covering;

iii. an upper female snap half and a lower female snap half are fixed in the inside flat strip and are oriented to mate with said male snap halves; and iv. the upper female snap half is located on the inside flat strip near an inside top end of the holder and the lower female snap half is located below the upper female snap half.

4. The invention as defined in claim 3 and further comprising:

f. said snaps being designed so that when the male and female halves are coupled, tension applied to the U-shaped holder away from the leg covering at any point other than the inside top end of the inside flat strip will be resisted and the U-shaped holder will not detach.

5. The invention as defined in claim 2 further comprising:

e. the outside top end of the outside flat strip is located closer to the top of the leg covering than to the instep and therefore f. the decorative logo is located closer to the top of the leg covering than to the instep.

6. The invention as defined in claim 2 wherein the U-shaped holder is attached to the boot by:

e. a strip sewn to the outside surface of the leg covering of the boot forming a sleeve and said sleeve oriented so that a linear axis of the sleeve is parallel to a center axis of the leg covering; and f. the inside flat strip telescoped within said sleeve through a bottom opening between the strip and leg covering.

7. The invention as defined in claim 6 and further comprises:

g. the strip is leather and the top of said sleeve is sewn to the leg covering.

8. A process for connecting a decorative logo to a boot including:

a. a boot having;

i. a big toe side and little toe side, ii. a sole, iii. an instep, iv. a heel, v. a foot covering, and vi. a tubular leg covering having a top;

wherein the improved method for connecting a logo to the boot comprises the following steps:

b. attaching a U-shaped holder to the little toe side of the tubular leg covering i. so that the holder is oriented with an inside top end and an outside top end of the holder towards a top opening of the tubular leg covering, and ii. so that a bight of the U-shaped holder is closer to the instep than the top of the leg covering;

c. placing a pant leg which is being worn with the boot into a bight of the U-shaped holder where the pant leg is restrained at an elevation above ground level, and d. attaching the decorative logo to the outside top end of the holder so that the outside top end and the logo is closer to the top of the leg covering than to the instep and so that said logo is outside the pant leg.

9. The invention as defined in claim 8 wherein the attaching of the U-shaped holder to the boot comprises:

d. sewing a strip of material to the outside surface of the little toe side of the leg covering of the boot and oriented so that a linear axis of the strip is parallel to a center axis of the leg covering; thus e. forming a sleeve; and f. sliding an inside strip of the U-shaped holder up into the sleeve on the tubular leg covering.

10. The invention as defined in claim 8 wherein the attaching of the U-shaped holder to the boot comprises:

d. attaching snap halves to the little toe side of the leg covering;

e. attaching snap halves to the U-shaped holder; and f. snapping the holder to the leg covering by the mating snap halves.

11. A decorative logo attachment upon a. a boot having;

i. a big toe side and little toe side, ii. a sole, iii. an instep, iv. a heel, v. a foot covering, and vi. a tubular leg covering with a top;

wherein the improvement comprises the following structure in combination with the above:

b. a U-shaped holder having:

i. an inside flat strip connected to an outside flat strip by a 180 degree bend where said bend is at the bottom of both strips, ii. said 180 degree bend closer to the instep than to the top of the leg covering, iii. said U-shaped holder opens upward toward the top of the leg covering, sand iv. said outside flat strip projects upright and terminates in an outside top end at a height above the bend desireable for displaying a decorative logo and so that a pant leg may be inserted into said U-shaped holder;

c. fastener means on the tubular leg covering on the little toe side of the boot for interconnecting the holder to the leg covering on the little toe side of the boot;

d. the outside top end of the outside strip is located closer to the top of the leg covering than to the instep; and e. a decorative logo attached to the outside top end of the outside flat strip and located closer to the top of the leg covering than to the instep.

* * * * *